US005623731A

United States Patent [19]

Ehrgott et al.

[11] Patent Number: 5,623,731

[45] Date of Patent: Apr. 29, 1997

[54] DETACHABLE DEVICE FOR FASTENING AN OBJECT, LOCATED IN A CASE, TO A CARRIER

[76] Inventors: Rudolf Ehrgott, c/o Flimpex GmbH, Schuttelstrasse 67, A-1020 Vienna, Austria; Dirk Albrecht, c/o D.A.N.Z. Trading & Consulting, Bachweg 14, CH-6314 Edlibach, Switzerland

[21] Appl. No.: 369,692

[22] Filed: Jan. 6, 1995

[30] Foreign Application Priority Data

Jan. 6, 1994 [CH] Switzerland ..... 028/94
Apr. 7, 1994 [CH] Switzerland ..... 030/94

[51] Int. Cl.[6] ..... A41D 19/00

[52] U.S. Cl. ..... 2/160; 403/349

[58] Field of Search ..... 2/158, 159, 160; 403/348, 349, 350, 338, 335; 63/21, 29.1

[56] References Cited

U.S. PATENT DOCUMENTS

| | | | |
|---|---|---|---|
| 1,034,019 | 7/1912 | Leidig | 63/29.1 |
| 1,309,150 | 7/1919 | Monfort | 2/160 X |
| 1,374,257 | 4/1921 | Van Raalte | 2/160 |
| 1,416,653 | 5/1922 | Lenneberg | 2/160 |
| 1,416,654 | 5/1922 | Lenneberg | 2/160 X |
| 1,516,599 | 11/1924 | Gsell | 63/29.1 X |
| 1,524,137 | 1/1925 | Kastl et al. | 2/160 |
| 2,103,711 | 12/1937 | Cole | 2/160 |
| 2,333,428 | 11/1943 | Kinsey | 2/160 X |
| 3,933,011 | 1/1976 | DiGilio et al. | 63/29.1 |
| 4,281,389 | 7/1981 | Smith | 2/160 X |
| 4,353,124 | 10/1982 | Weinzettel et al. | 63/21 X |
| 4,387,838 | 6/1983 | Jackson | 2/160 X |
| 4,761,835 | 8/1988 | Chen | 2/160 |
| 4,766,611 | 8/1988 | Kim | 2/160 |
| 4,862,521 | 9/1989 | Mann | 2/160 |
| 4,939,913 | 7/1990 | Scungio et al. | 63/21 |
| 4,982,580 | 1/1991 | Otenbaker | 63/29.1 X |
| 4,982,581 | 1/1991 | Furuyama | 63/29.1 |
| 5,117,508 | 6/1992 | Gunter | 2/160 |

FOREIGN PATENT DOCUMENTS

| | | | |
|---|---|---|---|
| 2612051 | 9/1988 | France | 2/160 |
| 9308709 | 5/1993 | WIPO | 2/160 |

*Primary Examiner*—C. D. Crowder
*Assistant Examiner*—Shirra L. Jenkins
*Attorney, Agent, or Firm*—Browdy and Neimark

[57] ABSTRACT

A fastening device, with which an object such as a watch (100) can be secured detachably to a carrier, such as the back of a glove (116). To that end, a fastening element of the object and a fastening element of the carrier are provided, of which the first is mounted on the case of the object and the second is mounted on the carrier. A further bandlike carrier, such as a watchband, has a further fastening element of the carrier that can be connected to the aforementioned fastening element of the object, or to an additional fastening element of the object.

4 Claims, 4 Drawing Sheets

DETACHABLE DEVICE FOR FASTENING AN OBJECT, LOCATED IN A CASE, TO A CARRIER

BACKGROUND OF THE INVENTION

The invention relates to a fastening device used to fasten small objects, such as pedometers, altimeters or receivers, to articles of clothing. The clothes carriers are, for example gloves or portions of the sleeves of other articles of clothing, or bands on which the small objects are used for a time and from which they are then removed again afterward.

In various kinds of sports and occupations, it is desirable or necessary not to wear such objects, especially watches, in the usual way on a band against the skin, and thus under the clothing. For instance, if one wears gloves to protect against the cold in winter sports, or to avoid injuries to the skin while horseback riding or playing golf, then it is complicated to take off the glove every time or push it away from the wrist if one wants to look at his watch. This is even more the case if one wears a watch or receiver that has an acoustical signal device, since one usually wants to turn off the signals being given as quickly as possible. In medical professions or in activities where one puts his hands into contact with water or chemicals as well, it is preferable not to wear a watch on the wrist, either to protect patients against injuries or to protect the watch from damage. In those cases it is more practical to wear a watch on the lower arm region of the sleeve than to use a pocket watch or pendant watch, since to read a pocket watch or pendant watch one always needs a free hand, while a watch fixed to the sleeve can be read even if no free hand is available.

In every case, it is necessary that the fastening devices for such objects permit detachable fastening without destruction in a simple way. On the one hand, objects have to be removed in order to be set, adjusted or repaired, and in order to replace exhausted batteries, and objects that have become unusable must also be replaced with new ones. On the other, it must also be possible to remove objects from articles of clothing if the clothing becomes defective or dirty. Finally, it is desirable to secure an object to various kinds of carriers, and thus for instance in winter sports to use a watch on a glove while in everyday use it is used on a watchband.

2. Prior Art

Fastening devices for such purposes are known. For instance, U.S. Pat. No. 5,003,653 describes a sports glove on which, alternatively and sometimes even simultaneously, various objects such as watches, small pockets or radios can be fastened using Velcro tape. The thus-fastened objects can easily be removed and fastened to other large-area or band-like carriers. However, the danger always exists that objects secured in this way can be damaged, since they are not protected at the sides in any way but rather protrude above the glove all the way around. Moreover, they can easily be detached from the glove from shear or torsional forces that act upon them in a fall, for instance.

U.S. Pat. No. 4,761,835 also describes a glove onto whose back, again using Velcro tape, one face of a two-faced small case is secured. A watch or some other relatively flat object is placed between the two faces of the case. Reading the watch is done through recesses on the outer face, which is pressed against the inner face or on the back of the glove by means of a tab and tape device. Although this fastening device provides relatively good protection for a very flat object, once again the danger exists that the Velcro fastening will come undone.

U.S. Pat. No. 4,865,521 shows a glove with a small pocket that extends on the back of the hand into the inside of the glove and can be closed by a zipper, for instance. An object is thrust into this small pocket, and it can be read through suitable recesses in the material of the glove in the region of the back of the hand, which may be covered with transparent film. In this arrangement, the object is well protected both against damage and against loss, but this arrangement is poorly suited for securing an object to a bandlike carrier that is not overly wide.

International Patent Application WO 93/08 709 shows and describes a glove on whose back a fastening element of the carrier is mounted, while a fastening element of the object that cooperates with the other fastening element is mounted on various objects, such as a stop watch, a "wind-shield" wiper for ski goggles, and similar small objects. The two fastening elements are connected to one another by being pushed or rotated. With this glove, the objects are relatively securely fastened but hardly protected, since there is no provision for disposing them in recessed fashion. Another disadvantage is that when a watch, for instance, is removed from it and mounted on a watchband, the result is a watchband of considerable height, since both fastening elements have a certain thickness or height.

In summary, it can be stated that all the fastening devices described allow moving an object from a first carrier and mounting it on another carrier. However, in some of the fastening devices, the objects are virtually unprotected and/or are not fastened adequately securely. In particular, in all the fastening devices it is not possible to both securely fasten and adequately protect the objects perfectly both on a relatively large-area carrier and on a bandlike carrier.

The novel fastening device makes it possible to mount an object such as a watch securely and in a protected fashion on the one hand to a relatively large-area carrier, such as a glove or the sleeve of a lab coat, and on the other to do so on a narrow bandlike carrier, such as a watchband. This is accomplished by two cooperating fastening elements to be connected to one another in disconnectable fashion; one fastening element of the object comes into engagement with one element of the carrier or band in each case.

In a simple, practical embodiment, the object is especially well protected, because the fastening element of the carrier has a cylindrical container for receiving the object, and the depth of the container is at least approximately equivalent to the height of the case or housing of the object. In addition, the case has a protective cap with an opening, through which at least the display area of the object is visible, and which above all protects the vulnerable upper peripheral region of the case.

In another embodiment, the force of a resilient element is utilized in order to firmly hold the object on the carrier or band in a suitable receiving device.

This kind of fastening device is obtained by forming the fastening element of the object as a shoulder on the case, while the fastening element of the carrier or band has at least one elastic clamp element, with an operative surface area that rests on the aforementioned shoulder when the object is secured. For mounting and unmounting the object, the elastic clamp element is deflected into a position in which it enables the object to be inserted or removed from the receiving device.

In a preferred embodiment, the shoulder is formed by the upper rim of the case. The element of the carrier forms a container like receiving device for the object and at the same time forms a plurality of clamp elements, in that the vertical container wall, which is made of an elastic material, has vertical slits that begin at its upper rim and that laterally define the clamp elements, which comprise the remaining parts of the walls.

In both of the above-mentioned embodiments of the novel fastening device, the assumption was that the object has only a single fastening element of the object, which cooperates alternatively with a complementary fastening device of a large-area or bandlike carrier; the fastening elements of both types of carrier are in principle embodied identically. To connect the object especially advantageously to a bandlike carrier, which is especially desirable for a watch, the object may be provided with an additional fastening element toward the object, which is secured to the further fastening element toward the band. In this case, the fastening element toward the carrier and that toward the band are embodied differently.

For instance, the object, retained in a spring ring and formed onto its case, may have half of a bayonet mount, whose complementary half is mounted on a bandlike carrier.

Alternatively, the additional fastening element on the object, which serves to secure the object to a bandlike carrier, may essentially comprise two diametrically opposed attachments, which protrude radially past the case and extend at a tangent to the case. When the object is secured to the large-area carrier, these attachments are not needed. In this case, the aforementioned arrangement in which a container like receiving device is provided for the object, its walls being divided by slits into resilient clamp elements, is advantageously used as the fastening element of the carrier.

The attachments that serve the purpose of fastening to the bandlike carrier are received by the aforementioned slits when the object is secured to the large-area carrier. By a suitable distribution of slits over the circumference of the container like receiving device, the correct disposition of the object in the circumferential direction is moreover assured. When the object is disposed on the bandlike carrier, the attachments, which have bores extending longitudinally of them, are connected to complementary fastening elements of the band, generally by means of pins that are supported on the bores and protrude beyond them into aligned recesses of the securing elements of the band.

It is even more advantageous to provide not two attachments but rather two pairs of attachments on the case; the bandlike carrier is thrust in between the attachments of one pair, so that a typical watchband fastening is the result. In this case, it is necessary that the slits, which must receive the four attachments of the two pairs of attachments when the object is secured to the large-area carrier, be disposed not radially but rather in the direction of the various attachments.

A very secure fastening is obtained if the fastening element of the object on the one hand and the fastening element of the carrier or band on the other are embodied or disposed such that they can be made to engage one another in the manner of a bayonet mount. In this way, a correct disposition of the object in the circumferential direction is simultaneously obtained, without having to provide additional positioning devices for the purpose.

An advantageous embodiment of the bayonet mount-like fastening elements is embodied such that the element of the object is formed onto the bottom of the case via a spacer protuberance and has two radially outward-protruding attachments. The fastening element of the carrier or band is embodied as a ring and mounted on the carrier or band in such a way that a free space is created between the carrier or band and the ring.

The ring has radial recesses, beginning at its inner rim, that are embodied in complementary fashion to the attachments. One attachment or recess has a larger size radially and a smaller size circumferentially than the other attachment or recess. This assures that the object cannot ever be secured to the carrier in the wrong position.

BRIEF DESCRIPTION OF THE DRAWINGS

Further details and advantages of the fastening devices according to the invention will be described below in detail in terms of several exemplary embodiments, and in conjunction with the drawings.

Shown are.

DETAILED DESCRIPTION OF THE PREFERRED EMBODIMENT(S) OF THE INVENTION

For better comprehension, it will also be noted that the terms "above" and "below" in each case refer to an object that is in a horizontal position.

Figure 1:
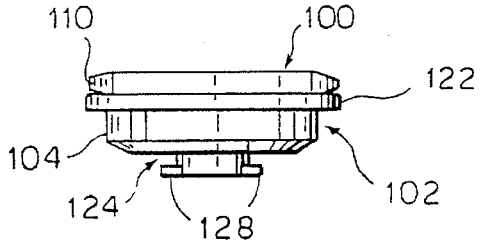
FIG. 1, a watch with an analog display, in a side view.

A watch 100 shown in FIG. 1 has a case 102 with an at least partly cylindrical wall 104, a bottom 106, and a dial, protected by glass or transparent plastic. The upper rim region of the case is surrounded by a protective cap 110, which is slightly elastic and can be slipped onto the upper part of the case. This protective cap 110 can be rotated relative to the dial 108 in the mounted state. Recesses 112 disposed on the rim of the protective cap 110 make it easier to remove the protective cap from the case 102 again and also to rotate the protective cap in the mounted state.

These recesses 112 and/or additional markings on the top of the protective cap 110 may also serve to mark predetermined preselected times. The cylindrical portion of the wall 104 represents the fastening element of the object.

A fastening element of the carrier, embodied as a spring ring 114, is secured on top of the carrier, in this case on top of a glove 116 or band 117. This can be done by merely pressing it in, or by adhesive bonding, or by some other suitable mode of fastening. An outer layer 118 of the material making up the glove 116 or band 117 covers at least the inner wall 121 of the spring ring 114. Between this downward-pulled part of the outer layer 118 and the spring ring 114 is a layer 120, preferably of plastic, which also extends over the upper peripheral region of the spring ring 114.

For fastening the watch 100 to the glove 116 or band 117, the watch is merely pressed into the interior of the spring ring 114, and for removing the watch 100 from the glove 116 or band 117 it is pulled out, by grasping it on its upper case region 122, which like the protective cap 110 has a larger diameter than the wall 104 of the case 102, and pulling it away upward, optionally while simultaneously rotating it in order to overcome the frictional engagement.

Figure 2:
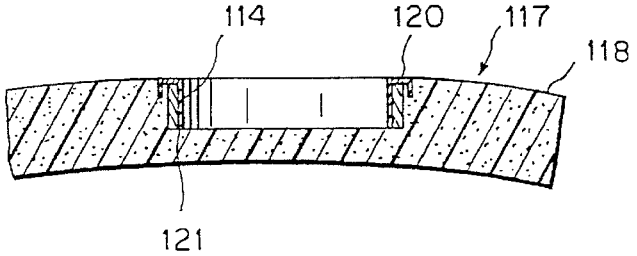
FIG. 2, a glove serving as the carrier, with a fastening element of the carrier, shown as a detail in the vertical section.
Figure 3:
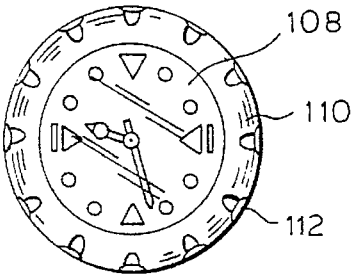
FIG. 3, the watch of FIG. 1, in a view from above.

In the same way as on the glove 116, the watch 100 can be secured to a bandlike carrier 117, as in FIG. 2 and which has a corresponding fastening element on the band, in the form of a spring ring.

Figure 4:
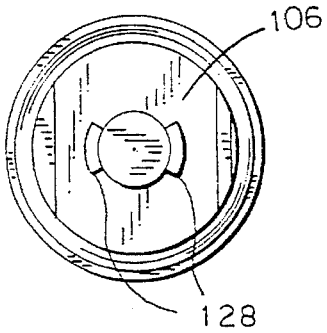
FIG. 4, the watch of FIG. 1, in a view from below.
Figure 16:
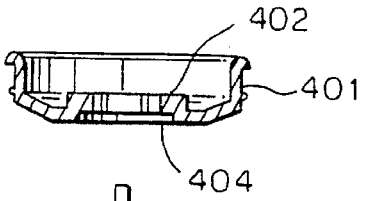
FIGS. 16–24, a fourth glove serving as a carrier, with a fastening element of the carrier and a fourth watch, in various views, analogous to the views of FIGS. 10–15.
Figure 17:
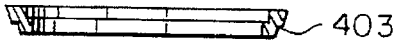
Figure 18:
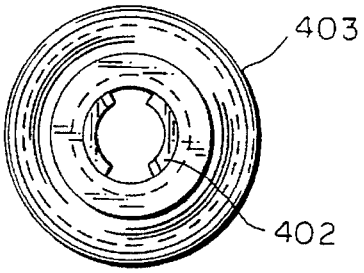
Figure 19:
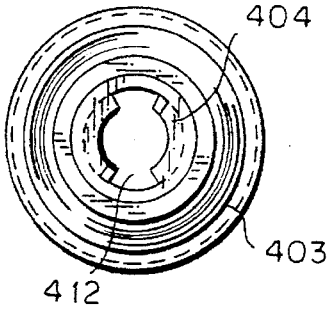
Figure 20:
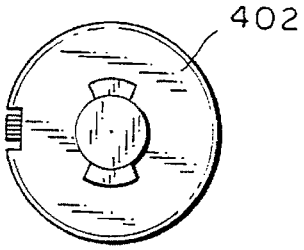
Figure 21:
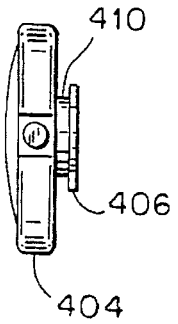
Figure 22:
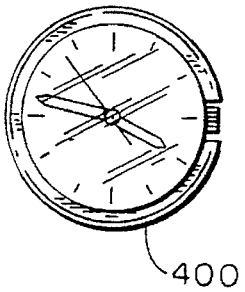
Figure 23:
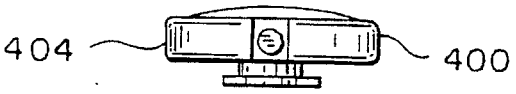
Figure 24:
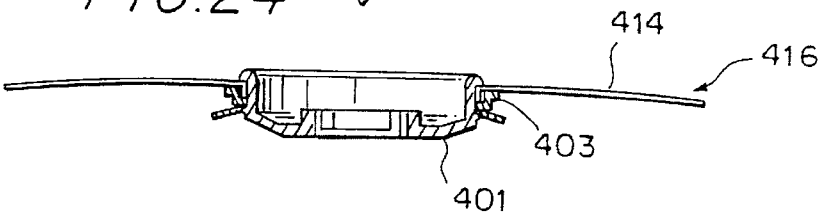

In the present example, however, the watch has as an additional fastening element 124 one-half of a fastening device that acts in the manner of a bayonet mount. The other half of this device, or in other words the complementary part of the bayonet mount can be located on the bandlike carrier as shown in FIGS. 16 and 24. This additional fastening element 124 substantially comprises a central protuberance extending downward from the bottom 106 of the case 102, on which protuberance two diametrical disklike attachments 128 are provided on the bottom, as can be clearly seen from FIG. 4.

Figure 5:
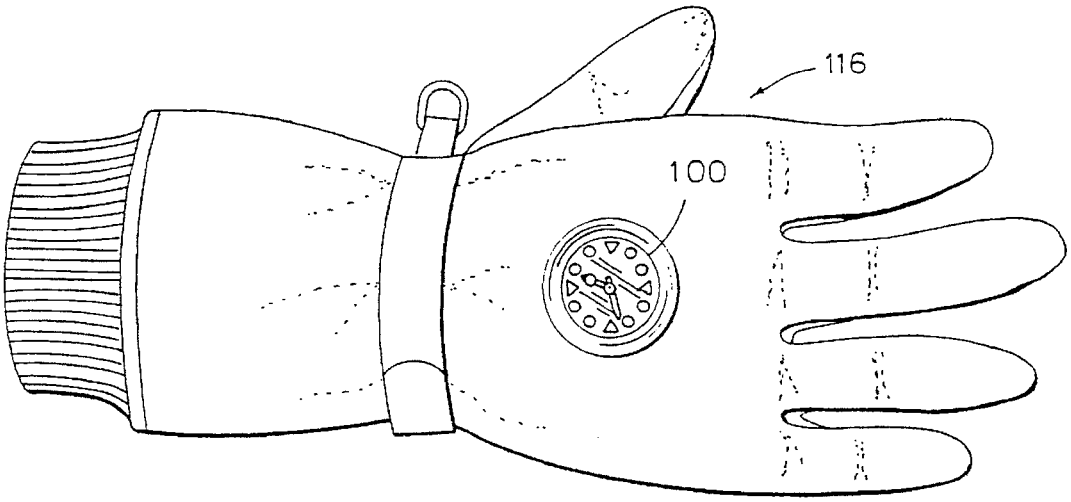
FIG. 5, a glove with the watch secured in it, in a view from above.

In FIG. 5, the watch 100 is disposed in the middle of the back of the glove 116. However, it is also possible to secure it slightly offset toward the thumb, which makes it easier to read. It is also naturally possible to dispose an additional object or some other object such as an altimeter, to the glove 116 in the same way.

In the fastening device just described, it is advantageous above all that while being extremely simple in design, it forms an efficient retention and simultaneously provides effective protection for the watch or other object.

Figure 6:
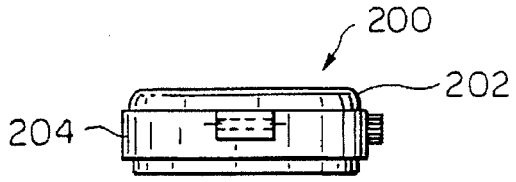
FIG. 6, a second watch with an analog display, in a side view.

A second type of a fastening device according to the invention is shown in FIGS. 6–9. FIG. 6 shows a watch 200, in which a shoulder 202 on the upper rim of the case 204 forms the fastening element of the object.

Figure 7:
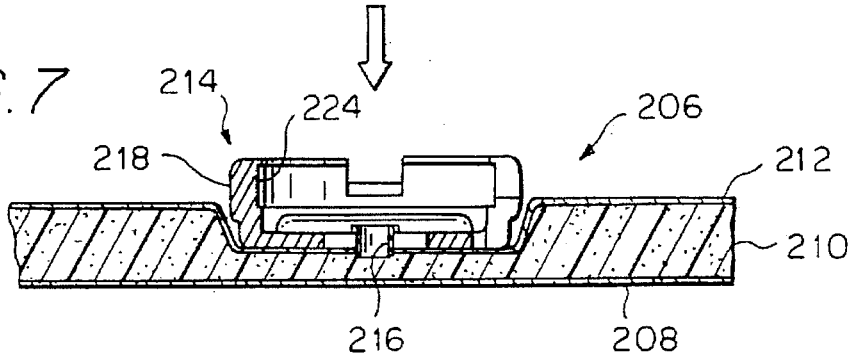
FIG. 7, a second glove serving as the carrier, with a fastening element of the carrier, shown as a detail in the vertical section.

FIG. 7 shows the detail of a glove 206, which made of a three-layered material comprising an inner layer 208, a middle insulating layer 210, and an outer layer 212. A fastening element of the carrier, in the form of a container like receiving device 214 for the watch 200, is secured to one part of the glove 206, on which part the insulating layer is thinned or is compressed. The receiving device 214 comprises an elastic material, for instance a suitable plastic, and is mounted to the glove via a fixation device 216, or by adhesive bonding in a manner not shown. The receiving device 214 has an approximately cylindrical peripheral region 218, which is provided with a plurality of slits 220 distributed over the circumference, which splits the peripheral region 218 into a plurality of elastic clamp elements 222. To secure the watch 200 in the glove, the watch is pressed from above onto or into the receiving device 214; this bends the clamp elements elastically outward, so that the watch can be pushed into the receiving device. When the clamp elements 222 thereafter snap elastically back again in resilient fashion, the operative faces 224 come to rest on the offset 202 of the case 204 and prevent the watch 200 from being removed from the glove 206.

Figure 8:
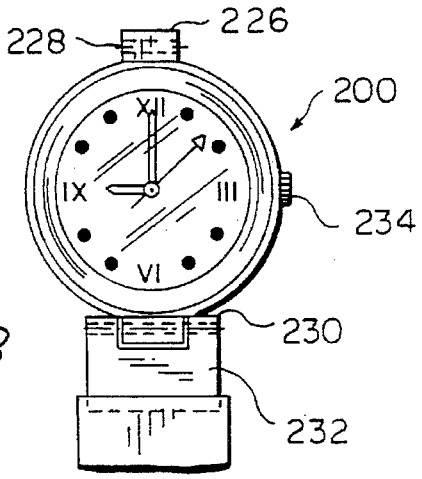
FIG. 8, the watch of FIG. 6, in a view from above.

In this arrangement it is possible, in the same way as the watch is fastened to the glove, to fasten the watch to a bandlike carrier as in FIG. 7 that has a receiving device embodied like the receiving device 214 described. However, a substantially more-compact and more-practical wristwatch is obtained if the case 204 is provided with an additional fastening element, comprising two diametrical attachments 226, as shown in FIG. 8. These attachments 226 have bores 228 so that each can receive one pin 230, whose ends protruding from the bores 228 are received by a U-shaped part 232, secured to the watchband, that forms the fastening element of the band.

Figure 9:
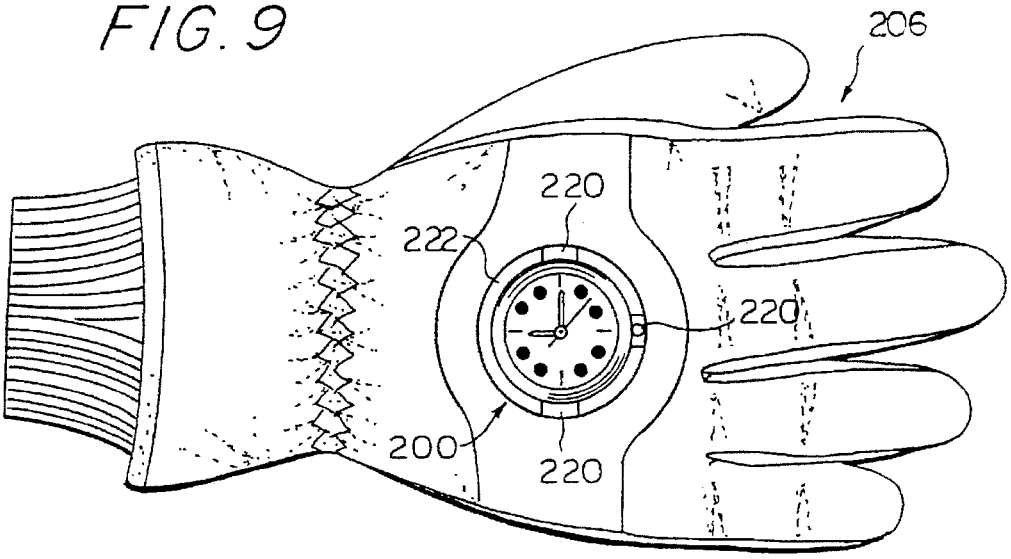
FIG. 9, the second glove with the watch secured in it, in a view from above.

FIG. 9 shows that the slits 220 that define the clamp element 222 simultaneously serve to receive the attachments 226. A further slit can serve to receive a non-recessed stem 234.

The advantage of the thus-described arrangement is that when mounted on a watchband a genuine wristwatch, of relatively elegant appearance, is created. On the other hand, the watch is a little less well protected on the glove than in the exemplary embodiment described first above.

Figure 10:
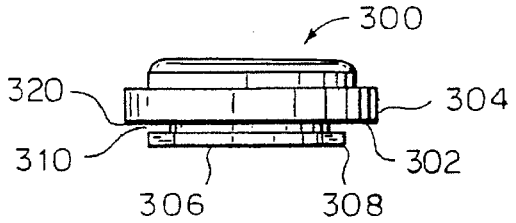
FIG. 10, a third watch with an analog display, in a side view.
Figure 11:
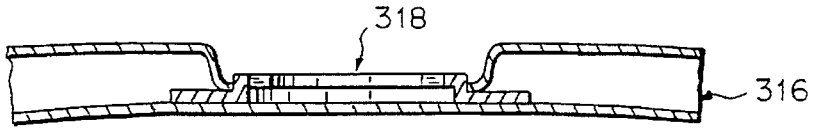
FIG. 11, a third glove serving as the carrier, with a fastening element of the carrier, shown as a detail in the vertical section.
Figure 12:
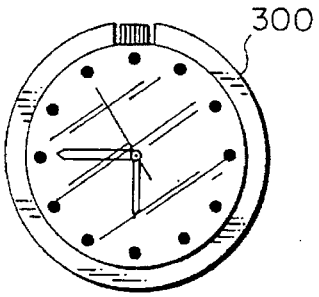
FIG. 12, the third watch with an analog display in a view from above.
Figure 13:
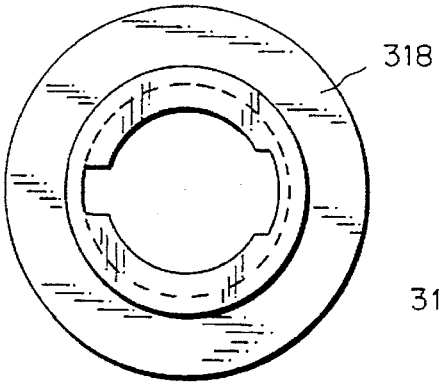
FIG. 13, the fastening element of the carrier, in a view from above.
Figure 14:
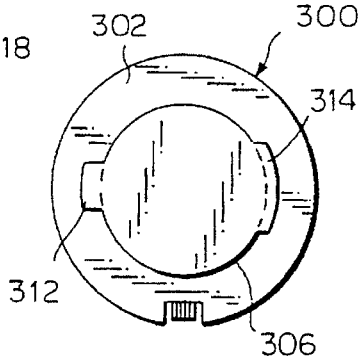
FIG. 14, the watch of FIG. 12, in a view from below.
Figure 15:
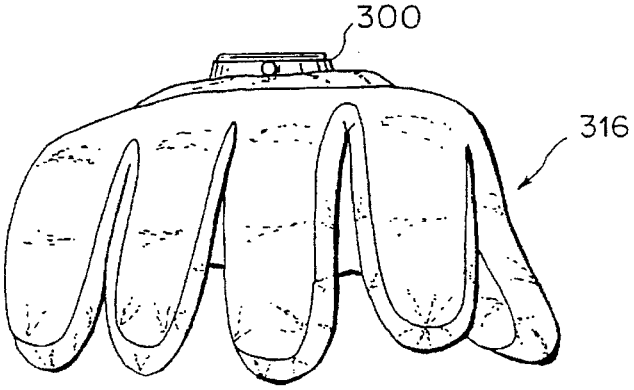
FIG. 15, the third glove with the watch of FIG. 10 secured in it, in a side view.

A third embodiment is shown in FIGS. 10–15. FIG. 10 shows a third clock 300 with a bottom 302, a wall 304, and a fastening element 306 of the object that is formed onto the bottom 302. This element is embodied by a disk 308, which is joined to the bottom 302 via a spacer piece 310. As shown in FIG. 14, this disk 308 has a first protrusion 312 and a second protrusion 314, disposed diametrically from the first. The protrusions are different both in terms of their outer radii and in terms of their dimensions circumferentially, as can clearly be seen from FIG. 14. The disk 308 forms one half of a fastening device that operates on the principle of a bayonet mount. The second half of this bayonet mount is fixed in a glove 316, as shown in FIG. 11, and substantially comprises a plate 318, which is disposed spaced apart from the surface 320 on which it rests. The plate 318 has recesses, which are complementary to the attachments 312 and 314, so as to receive these attachments when the watch 300 is secured in the glove 316.

As soon as the attachments, when the watch is secured to the glove, have been placed in the free space under the plate 318, the watch is rotated and is then secured against falling out of the glove.

In this arrangement, the watch 300 is not provided with any additional fastening element by means of which the watch could be secured to a watchband. However, the watch is shaped such that it can easily be inserted into a spring ring on a watch band of the type shown in FIGS. 2 or 7.

A fourth embodiment is shown in FIGS. 16–24. FIG. 16 shows a carrier case 401 of plastic in a sectional view, intended to receive a fourth watch or measuring device 400 shown in FIGS. 20–23 with its case rim or sides 404 recessed within the vertical cylindrical sides of the carrier case 401. This carrier case is joined to the middle-layer material 414 of a three-layered material of a bandlike carrier or glove 416 by clamping (as shown in FIG. 24) by means of a counterpart clamping ring 403 (see FIG. 17) which is shown in the mounted state in FIGS. 18 (seen from above) and 19 from below. The upper and lower layers of the three-layered material is discontinued to permit clamping of the middle-layers 414 by clamping ring 403. The fourth watch 400 (see FIGS. 20–23) has a bottom 402, which is designed such that in the mounted state it rests on the bottom of the carrier case 401. A bayonet like mount 412 on the carrier case 401, having both an upper and a lower stop 402, 404', serves to allow a first fastening element 406, mounted on spacer 410 on the fourth watch 400, to be locked in this mount or second fastening element 412. As noted above, engagement of the fastening device is completed by joining middle layer 414 to carrier case 401 by means of clamping ring or third fastening element 403.

Although in the above description reference has always been made to watches, gloves, and watchbands, the fastening devices described can naturally also be employed for other objects and for both large-area and bandlike carriers.

We claim:

1. A fastening device detachably fastening a measuring device to a carrier, said fastening device comprising:

a first fastening element fixed to a said measuring device, a second fastening element having cylindrical sides, said first fastening element detachably and mechanically engaged to the second fastening element, sides of the case of said measuring device recessed within the cylindrical sides of said second fastening element and a face of the measuring device being exposed when said first fastening element is engaged to said second fastening element, a third fastening element engaging a carrier to the second fastening element, wherein the first fastening element and the second fastening element are complementary halves of a bayonet mount device, and the third fastening element is a clamping ring corresponding to the cylindrical sides of the second fastening element.

2. The fastening device of claim 1 wherein the carrier is a middle-layer material of a three layer material.

3. The fastening device of claim 1 wherein the carrier is a glove.

4. The fastening device of claim 1 wherein the carrier is a band.

* * * * *